US005803391A

United States Patent [19]

Saperstein et al.

[11] Patent Number: 5,803,391

[45] Date of Patent: Sep. 8, 1998

[54] MESH STORAGE APPARATUS

[76] Inventors: Steven B. Saperstein; Sheila A. Angel, both of 909 Hulon La., West Columbia, S.C. 29169; James Hamilton, 1102 Barnwell St., Columbia, S.C. 29201; Lewis S. Wayburn, 434 Grantham Rd., Irmo, S.C. 29063

[21] Appl. No.: 695,429

[22] Filed: Aug. 12, 1996

[51] Int. Cl.[6] ..... B65H 75/34; B65H 75/48; B65D 65/02; E06C 1/52

[52] U.S. Cl. ..... 242/395; 242/379; 182/73; 182/196; 211/41.8; 150/154; 206/410; 410/97

[58] Field of Search ..... 242/395, 520, 242/918, 919, 471, 379, 379.2, 385–385.4, 398, 400, 588.3, 588; 43/7, 8, 9.95, 11, 14; 47/20, 21, 28.1, 31; 150/154; 206/409, 410; 256/43; 296/100, 101, 136; 182/73, 96; 53/118, 119, 441, 556; 410/154, 97, 100; 211/41.8, 41.9, 74, 180

[56] References Cited

U.S. PATENT DOCUMENTS

| | | | |
|---|---|---|---|
| 530,525 | 12/1894 | Hoekstra | 182/73 |
| 906,848 | 12/1908 | Atwell . | |
| 1,300,972 | 4/1919 | Janssen . | |
| 1,363,424 | 12/1920 | Matheson | 43/14 |
| 1,526,126 | 2/1925 | Fitzherbert . | |
| 3,232,291 | 2/1966 | Parker | 206/410 |
| 3,647,152 | 3/1972 | Trewella | 242/532.6 |
| 3,707,799 | 1/1973 | Hatley | 43/8 |
| 4,088,317 | 5/1978 | Gierla | 273/31 |
| 4,204,354 | 5/1980 | Kane | 43/4.5 |
| 4,316,501 | 2/1982 | Connoly | 53/556 |
| 4,347,680 | 9/1982 | Kaestner | 43/8 |
| 4,595,155 | 6/1986 | Gough | 242/848 |
| 4,764,998 | 8/1988 | Norris et al. | 242/919 |
| 4,832,206 | 5/1989 | Cunningham | 211/41 |
| 4,834,446 | 5/1989 | Tunt-Chow | 296/136 |
| 4,993,719 | 2/1991 | Hernandez | 273/411 |
| 5,063,647 | 11/1991 | Rohrer et al. | 242/520 |
| 5,078,330 | 1/1992 | Hall | 296/136 |
| 5,086,988 | 2/1992 | LaPoint et al. | 242/395 |
| 5,288,122 | 2/1994 | Pilhall | 296/24.1 |
| 5,518,126 | 5/1996 | Davis | 211/41.8 |

*Primary Examiner*—John M. Jillions

[57] ABSTRACT

A mesh storage apparatus comprises a conformal mesh member (14), which is attached to a retraction mechanism (10). Because the mesh member (14) has a point of attachment (20), rather than multiple points spread along one of its sides, the force of the retraction mechanism or another applied force collapses the mesh member along its major diagonal (13) into an elongated form, similar to that of a cable, rope, or strap, allowing for easy storage. It, therefore, takes advantage of the contractility of the mesh openings and the behavioral characteristics of conformal material under tension to store the mesh member (14) in a much more compact manner than with traditional storage apparatus.

9 Claims, 9 Drawing Sheets

MESH STORAGE APPARATUS

BACKGROUND-FIELD OF INVENTION

This invention relates to the storage of mesh members, specifically to the storage of conformal mesh members that are rotatably retractable.

Background-Description of Prior Art

The difficulties of storing mesh members, such as nets, have long been recognized. Stored flat or hung up, they consume a large amount of space; and folding them can result in tangling. Furthermore, they can catch easily on other objects, unless they are placed in containers, covered, or put well away from other objects.

In response to these difficulties, inventors have created devices that store mesh members or nets, by retracting them onto two categories of rollers. In the first category, the width of the roller is the same as the width of its net. Attached to the rollers, the nets can be extracted for use and retracted for storage or portability. These net storage devices are designed for different, but specific, purposes and retract their respective nets in various ways. The common feature is that all the nets are rotatably retractable, with no change in width. One use, restraining cargo, is typified by U.S. Pat. No. 5,288,122 issued to Pilhall. Another use is to restrain lighter items, such as plastic bowls and cups in a dishwasher. This type of net device is typified by U.S. Pat. No. 4,832,206 issued to Cunningham. A third use is sporting nets, such as volleyball and tennis nets. This use is typified by U.S. Pat. Nos. 906,848 issued to Atwell, 1,300,972 issued to Janssen, 1,526,126 issued to Fitzherbert, 4,088,317 issued to Gierla, 4,595,155 issued to Gough, and 4,993,719 issued to Hernandez.

Some of these previously referenced patents, U.S. Pat. Nos. 906,848, 1,300,972, 4,088,317, 4,832,206, and 4,993,719 disclose devices that are removable for easy portability or repair. The others disclose permanently mounted devices.

One major drawback of the prior art is that each device is designed only for a single purpose. For example, the cargo net cited above is designed for use only in an estate car (station wagon); Cunningham's patent describes a device for use only in a dishwasher; and the sports nets are designed only for specific sports, especially tennis and volleyball (even though they could easily be adapted to related sports, such as badminton).

A second problem with the above-mentioned devices is that each of these devices uses a long roller or other retractor, approximately the same width along the axes of rotation as the width of the net, similar to the relationship in a window shade between the width of its roller and the width of the shade. This condition occurs, because each of these nets is attached to its respective roller along an entire edge, side, or width of the net. Therefore, the width of the roller limits the usable space, especially in a compact environment such as a dishwasher. For example, Cunningham's dishwasher device has a roller that is mounted on the dishwasher rack, thus preventing items from being placed in the rack where the roller is mounted. If the whole rack is to be covered by the net, one entire rack row would not be able to be used to place dishwasher items (e.g. glasses, cups, bowls, utensils, etc.). This loss of valuable rack space could force the operator to use two dishwasher cycles when one would otherwise have been sufficient.

A third problem with the prior art is that the net is scaleable in only one direction. The net can be lengthened by pulling more of it away from the retraction device, and it can be shortened by retracting part of it. The width, however, is fixed. This characteristic is a problem when the objects that need to be covered consume more space (width) than the retraction device is wide. In this situation, multiple devices would be needed simultaneously.

The second category consists of rollers which are narrower than the widths of the nets. The devices which use narrow rollers are typified by U.S. Pat. Nos. 3,707,799 issued to Hatley and 4,204,354 issued to Kane. One major disadvantage of this category of prior art is that each of these inventions is designed for a single purpose. For example, both patents cited disclose devices designed for use only with fishing nets.

A second major disadvantage is that these devices are not designed for portability. The devices cited above are mounted permanently to fishing boats.

A third disadvantage is that none of the devices in this category are designed for multiple scaleability. The lengths can be elongated, but the widths remain fixed. The entire widths are used; the devices are not designed to use partial widths.

A fourth disadvantage is that these devices lead to the bunching of their respective nets. Bunching is inefficient; it does not store the nets in the most compact manner, because it does not eliminate all the open space within the net. Additionally, bunching increases the chance of knotting and tangling.

Objects and Advantages

Several objects and advantages of our mesh storage apparatus are that it:

(a) facilitates a multi-purpose mesh member;

(b) is substantially narrower and more compact than the mesh member it stores, thus using only a very small volume (proportionately) for storing the mesh member;

(c) allows a mesh member to expand in two dimensions (for flat nets) or three dimensions (for three-dimensional nets, such as mesh bags and baskets) to allow the operator to use only as much of the mesh as is necessary; and, (d) is designed specifically for multiple scaleability by allowing partial use of a mesh member's width, length, and depth.

Other objects and advantages are that it:

(a) uses substantially less material, and thus fewer natural resources, than traditional devices; therefore, it is less expensive to produce than traditional mesh storage devices;

(b) can be mounted temporarily so that it is portable and can be used in multiple settings, or it can be mounted permanently to a object;

(c) is simple to use;

(d) enhances safety in some embodiments because of its simplicity;

(e) can be manufactured with any retraction mechanism, device, or method;

(f) can easily be manufactured with any type of conformal mesh; and, (g) reduces the chance of the mesh's tangling or catching on other objects.

Further objects and advantages of our mesh storage apparatus will become apparent from a consideration of the drawings and ensuing description.

DRAWING FIGURES

REFERENCE NUMERALS IN DRAWINGS

Figure 1A:
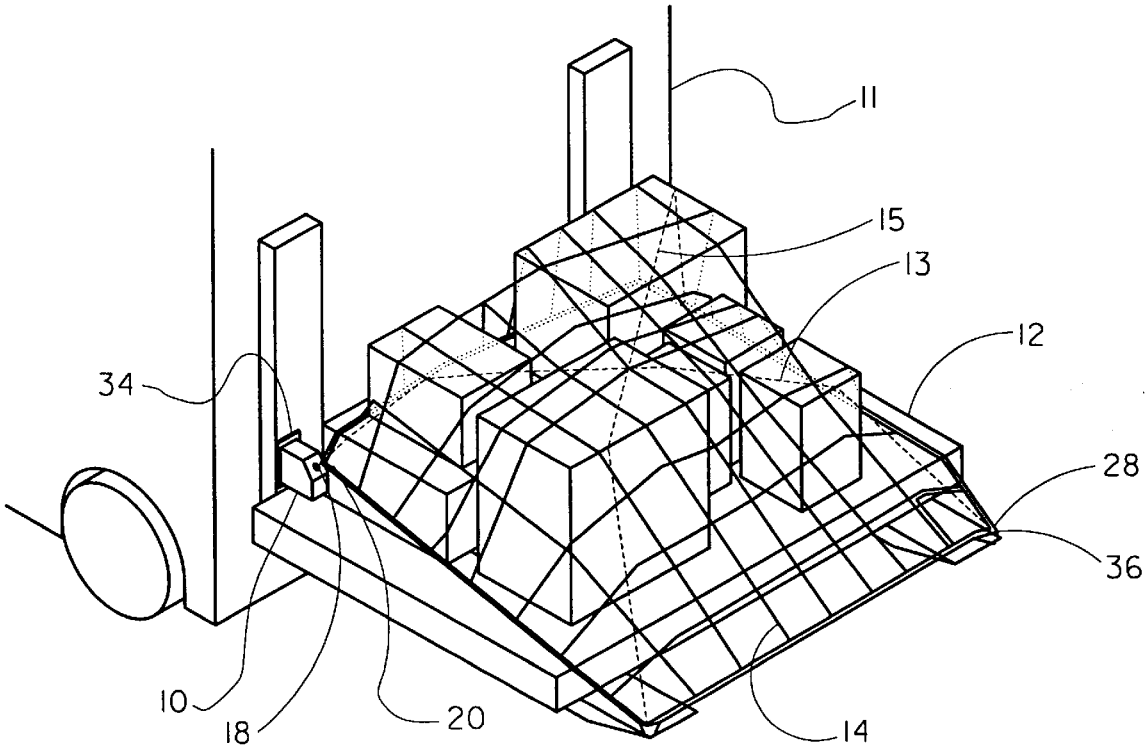
FIG. 1A is a perspective view of a preferred embodiment of this mesh storage apparatus relation to a forklift.

In the accompanying drawings, similar numeric characters of reference indicate corresponding parts in all the views; and similar alphabetic characters of reference indicate identical but different parts within the same view.

10 Retraction mechanism
11 Forklift
12 Pallet
13 Major diagonal
14 Mesh member
14A Mesh member
14B Mesh member
14C Mesh member
15 Minor diagonal
18 Opening
18A Opening
18B Opening
20 Point of attachment
22 Locking device
23 Window
24 Support point
25 Building
26 Stopper
27 Handle
28 Distal end
30 Connector
34 Mounting accessory
36 Leading point attachment
38 Truck bed
42 Dishwasher rack
46 Dishwasher articles

Summary

In accordance with our mesh storage apparatus, a conformal mesh member is attached to a retraction mechanism or device. Because the mesh is attached at a single or closed grouped set of points, rather than spread along one of its sides, the force of the retraction mechanism or another force collapses the mesh member along its major diagonal into an elongated form, similar to that of a cable, rope, or strap, allowing for easy storage. By taking advantage of the contractility of the mesh openings and the behavioral characteristics of conformal material under tension, the mesh member can be stored in a much more compact manner than with traditional storage devices.

Description of Invention

FIG. 1A illustrates a preferred embodiment of our mesh storage apparatus that is shown as a safety restraint on a forklift. However, our mesh storage apparatus can be used for multiple applications and in many settings. A retraction mechanism 10 is attached to a forklift 11 by a mounting accessory 34. Any suitable type of retraction mechanism can be employed, including, but not limited to, the types commonly employed with other retractable devices, such as electric cords and cables, tape measures, animal leashes, sports nets, and the like. Therefore, the details of the retraction mechanism are not shown here. Additionally, any suitable type of mounting accessory can be employed, including, but not limited to, a hook, clip, clamp, magnet, vacuum suction device, glue, screws, nails, snaps, string, hook and loop fasteners such as Velcro or Latchlok, and the like. The mesh storage apparatus frequently is attached to an object where it will be used. However, some embodiments of our mesh storage apparatus may not require attachment. For example, the apparatus can be hand held; or it can be hollow, filled with gas, or made of porous material so that it floats on water or in the air. Here a mesh member 14 is attached to the retraction mechanism at a point of attachment 20 and is shown completely deployed. The point of attachment can be a single point or a closely grouped set of points that is small relative to the size of the entire mesh. The mesh member is extracted through a hole or an opening 18 in the retraction mechanism and is attached to the forklift in order to cover a portion or all of a pallet 12 and its contents. Mesh member 14 is attached to the forklift in any suitable manner, including, but not limited to a hook, clip, clamp, magnet, vacuum suction device, glue, screws, nails, snaps, string, hook and loop fasteners such as Velcro or Latchlok, and the like. A major diagonal 13, defined as the line between point of attachment 20 and a distal end 28, and a minor diagonal 15, defined as the line perpendicular to the major diagonal, are also illustrated. Finally, a leading point attachment 36 is a device at the distal end that attaches the mesh member to an object. Here the leading point attachment is a solid diamond-shaped piece that encompasses the mesh opening at the distal end of the net. Some embodiments will not require a leading point attachment.

Figure 1B:
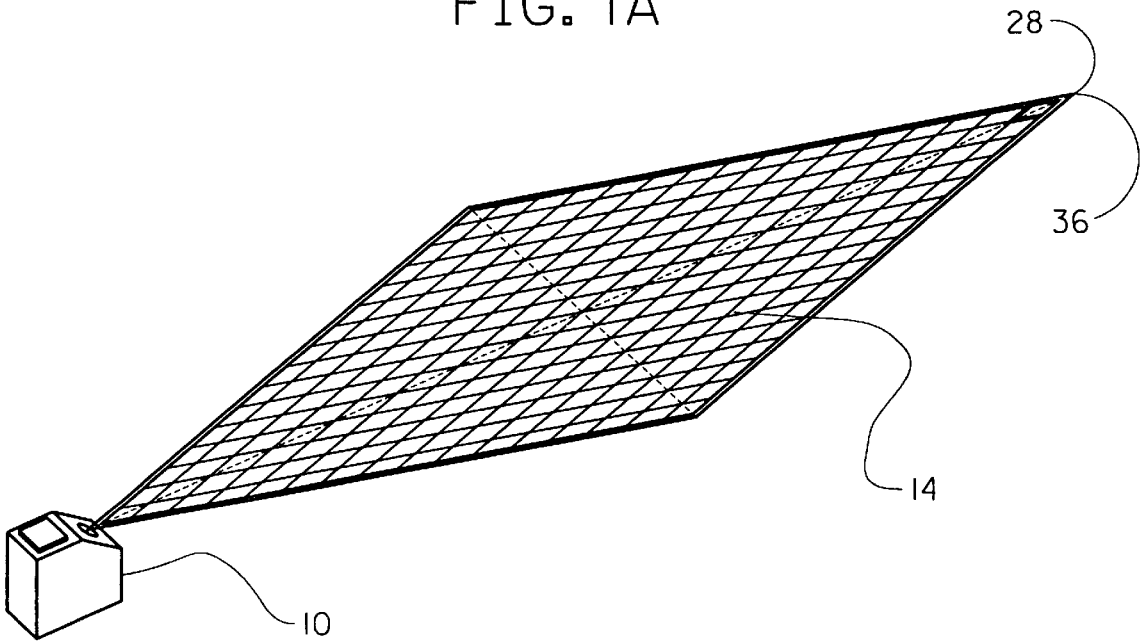
FIG. 1B is another view of the preferred embodiment illustrated in FIG. 1A with the mesh partially expanded.

FIG. 1B shows mesh member 14 in a partially deployed form, extending outwardly from retraction mechanism 10. Leading point attachment 36, located at distal end 28, is more easily seen in this enlarged view.

Figure 1C:
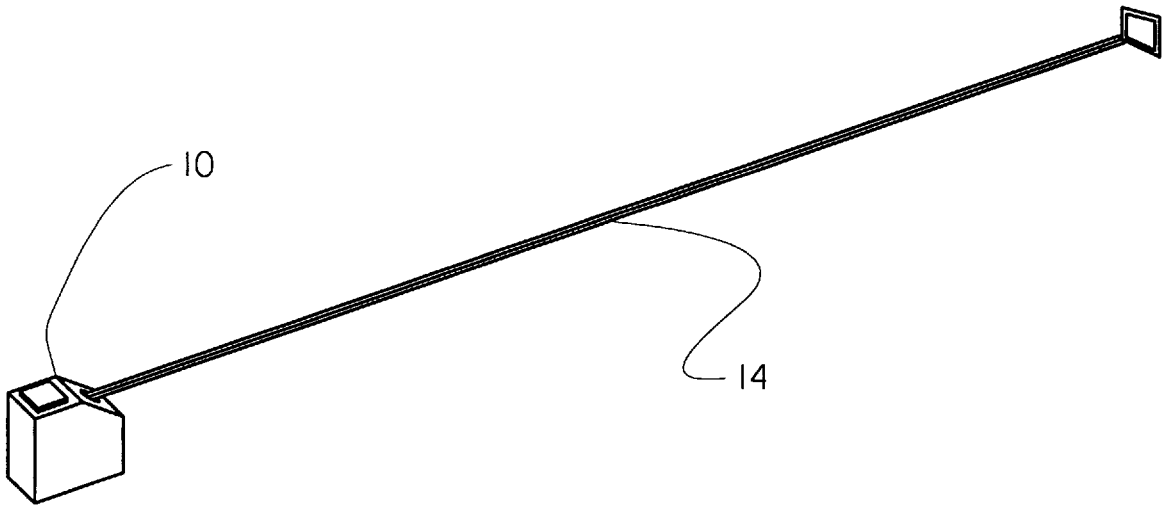
FIG. 1C is a third view of the preferred embodiment illustrated in FIG. 1A with the mesh in the collapsed position.

FIG. 1C shows mesh member 14 in a collapsed elongated form similar to that of a cable, rope, or strap, extending outwardly from retraction mechanism 10.

Figure 1D:
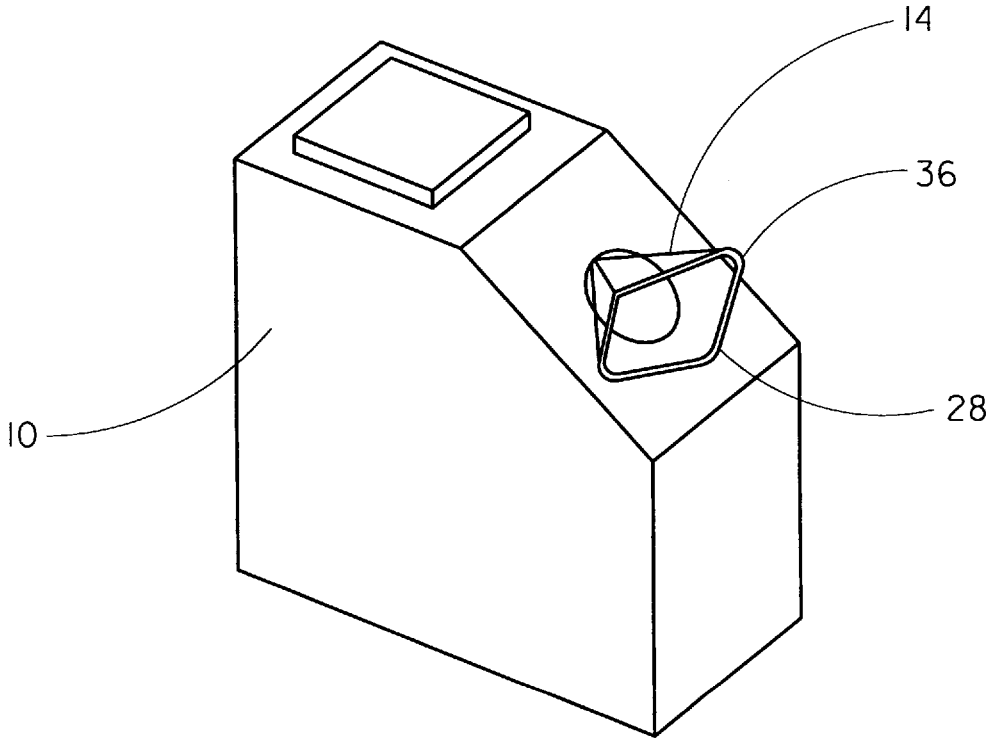
FIG. 1D shows a fourth view of the preferred embodiment illustrated in FIG. 1A with the mesh in the stored position.

FIG. 1D shows mesh member 14 in a stored position. A leading point attachment 36 is located at the distal end of the mesh. The leading point attachment can be any suitable device, including, but not limited to, a clip, clamp, hook, magnet, vacuum suction device, snaps, hook and loop fasteners such as Velcro or Latchlok, and the like. Here the leading point attachment also acts as a stopper to prevent unintentional retraction of the mesh.

Figure 2A:
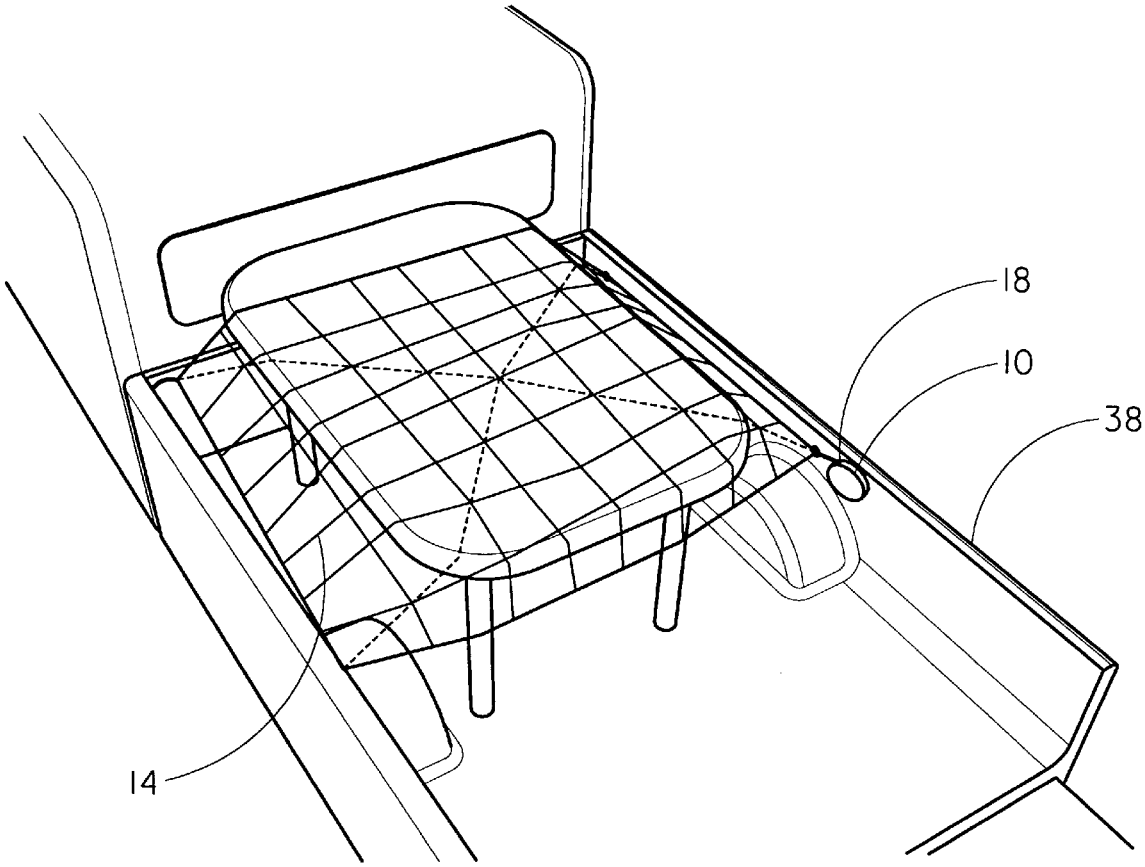
FIG. 2A is a perspective view of another preferred embodiment of this mesh storage apparatus. It is shown in relation to a pick-up truck.

FIG. 2A illustrates an alternative embodiment of our mesh storage apparatus, which is shown here as a cargo restraint apparatus in a truck bed 38. Retraction mechanism 10 is placed strategically in the truck bed. Mesh member 14 is extracted through opening 18 in the retraction mechanism and attached to the truck bed in order to cover a portion or all of the truck bed and its contents.

Figure 2B:
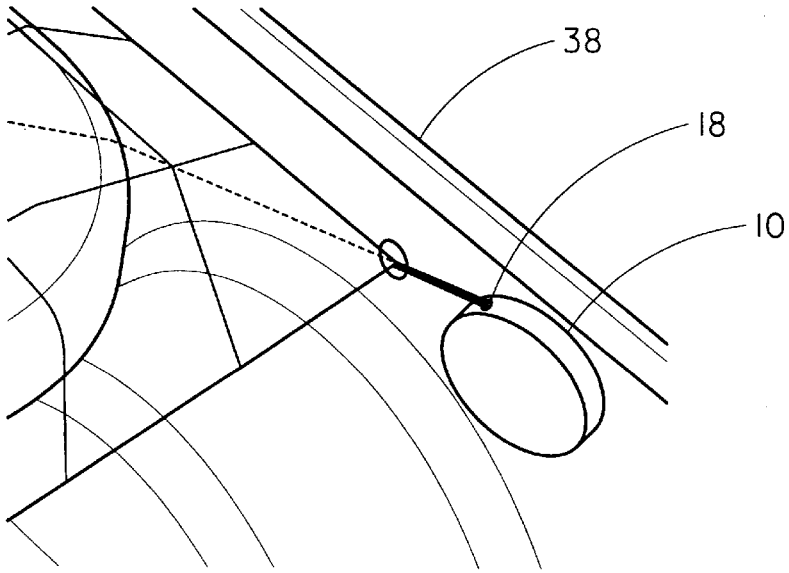
FIG. 2B is an enlarged view of the preferred embodiment illustrated in FIG. 2A.

FIG. 2B is an enlarged view of retraction mechanism 10 from FIG. 2A.

Figure 3A:
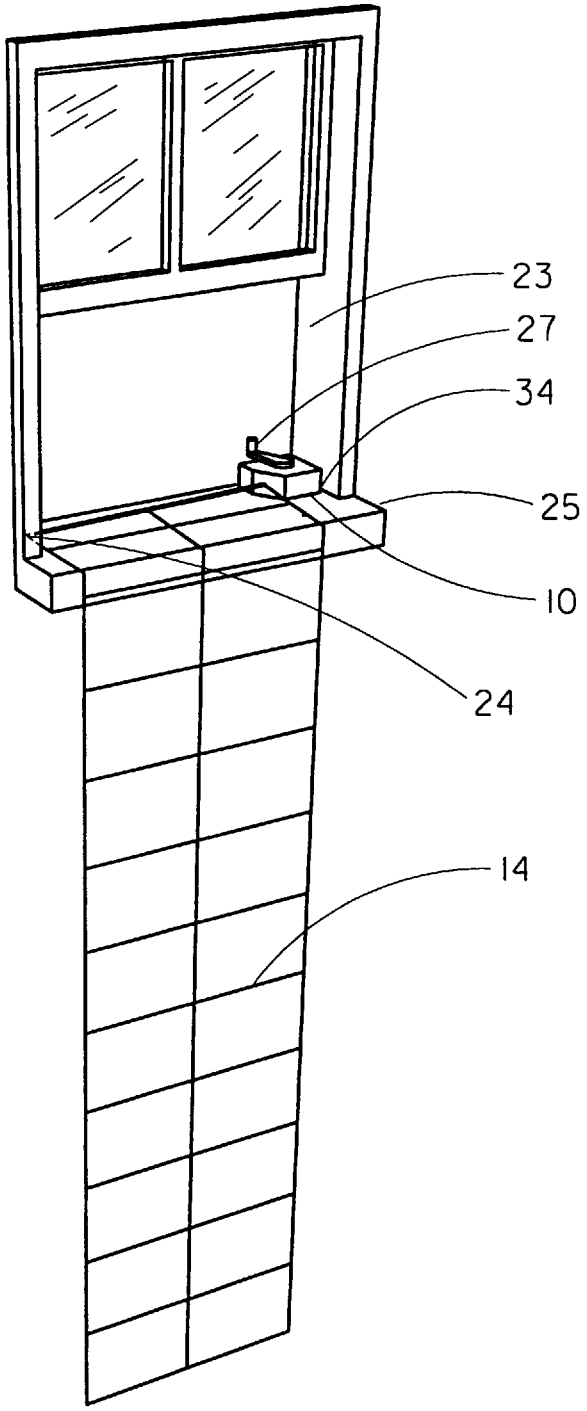
FIG. 3A is a perspective view of another preferred embodiment of this mesh storage apparatus. It stores a rope safety ladder.

FIG. 3A illustrates an alternative embodiment of our mesh storage apparatus, which in this drawing stores mesh member 14, an emergency escape ladder, which is deployed through a window 23. Retraction mechanism 10 is attached to a building 25 by mounting accessory 34. Also, the mesh member is attached to the building at a support point 24. This embodiment requires manual power to retract the mesh by rotating a handle 27.

Figure 3B:
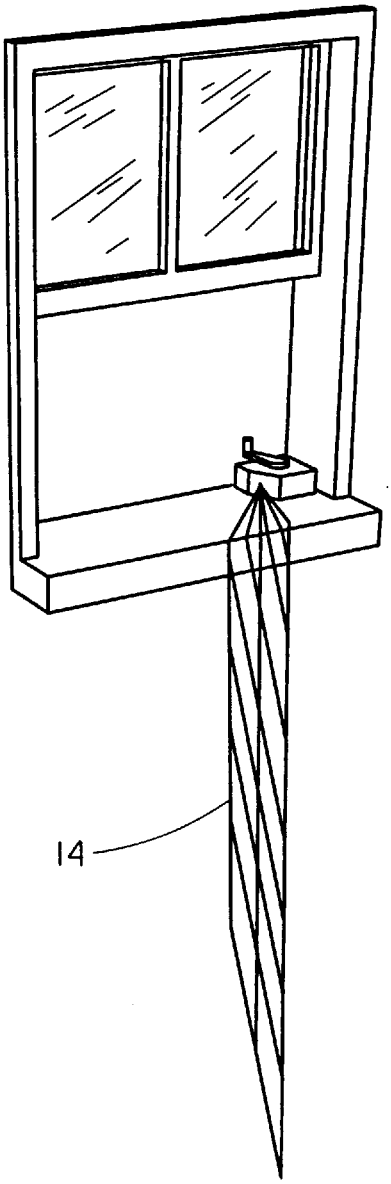
FIG. 3B is another view of the preferred embodiment illustrated in FIG. 3A with the mesh partially expanded.

FIG. 3B shows the mesh emergency escape ladder in a partially deployed form.

Figure 4A:
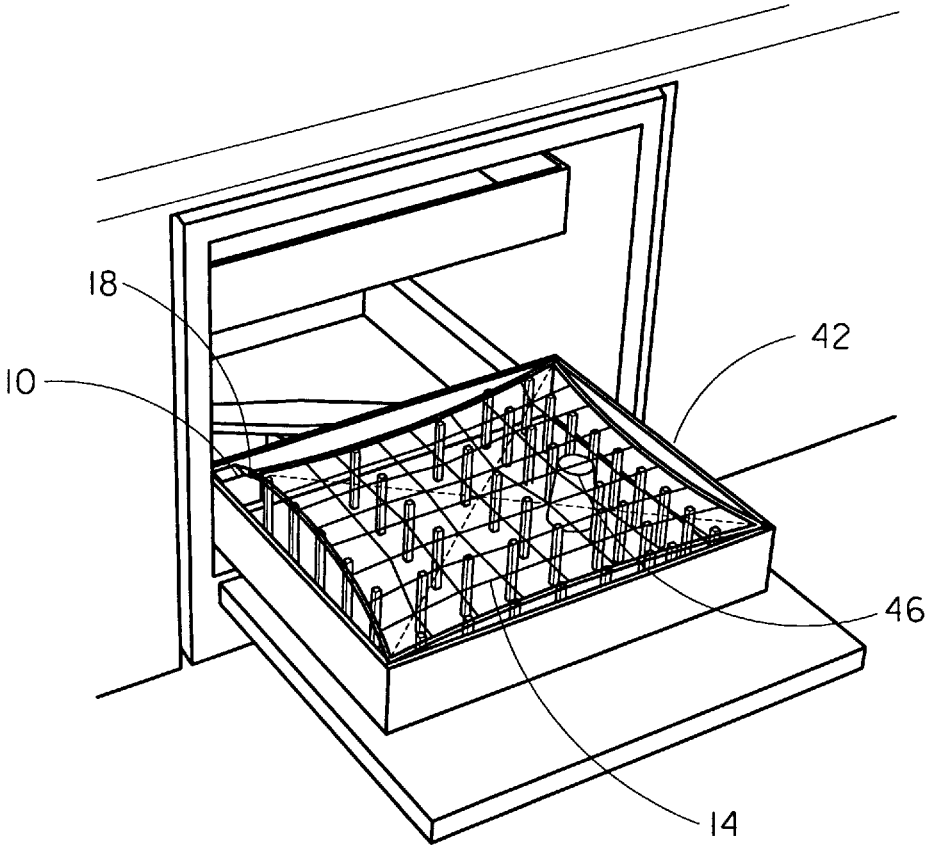
FIG. 4A is a perspective view of the preferred embodiment illustrated in FIG. 1A; however, it is shown in relation to a dishwasher rack.

FIG. 4A illustrates the preferred embodiment illustrated in FIG. 1A. The mesh storage apparatus is shown as a restraint for items in a dishwasher. Retraction mechanism 10 is mounted to dishwasher rack 42 in any suitable manner. Mesh member 14 extends outwardly through opening 18 in the retraction mechanism and is attached to the dishwasher rack in order to cover a portion or all of dishwasher rack 42 and dishwasher articles 46.

Figure 4B:
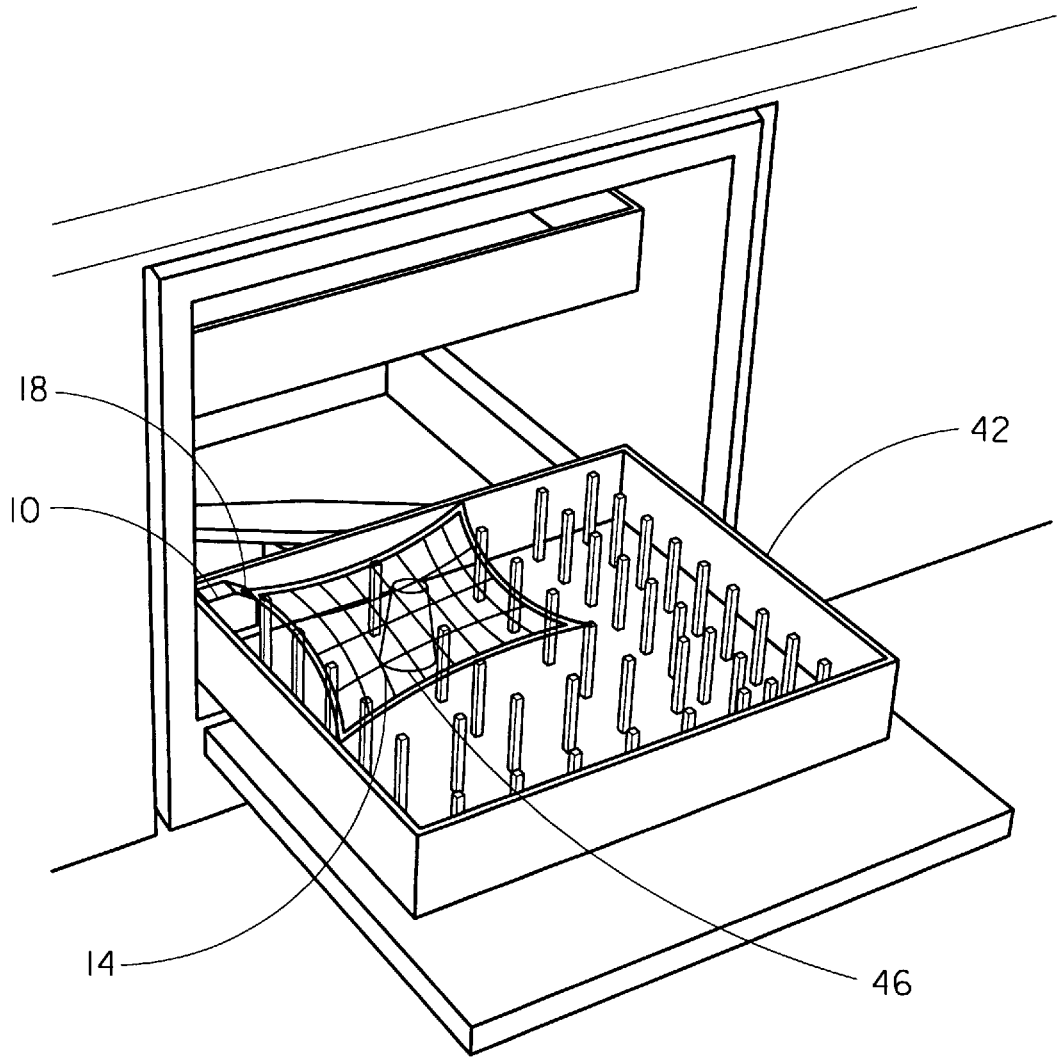
FIG. 4B is a second view of the preferred embodiment shown in FIG. 4A; it illustrates the multiple scaleability of the mesh storage apparatus.

FIG. 4B illustrates the multiple scaleability of the mesh member. It is scaled in terms of both length and width. Mesh member 14 extends outwardly from retraction mechanism 10 through opening 18. However, since only a portion of the rack contains items, only part of the dishwasher rack is covered.

Figure 5A:
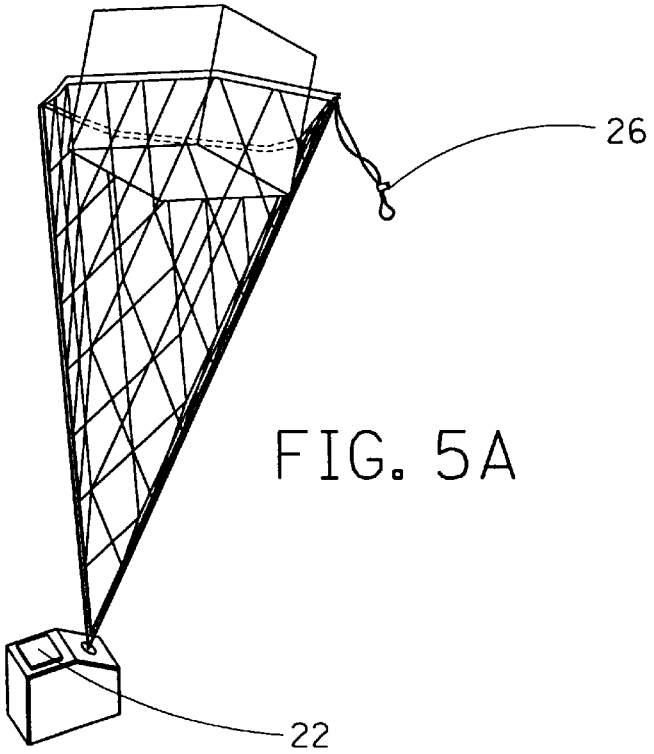
FIG. 5A shows the same embodiment as that in FIGS. 1A and 4A; however, it stores a three-dimensional mesh member.

FIG. 5A shows the same embodiment as does FIGS. 1A and 4A; however, this mesh storage apparatus stores a three-dimensional mesh member. Here the three-dimensional mesh member is a bag, but the mesh can have any shape and can be any type of conformal mesh made of any artificial or natural material, including, but not limited to, organic materials, plastics, metals, and any combination thereof. A stopper 26, which is also a drawstring in this illustration, is attached to the distal end of the mesh to prevent the mesh from retracting completely into the retraction mechanism. Stopper 26 can be any object that prevents the mesh from complete retraction. In many embodiments, the leading point attachment will also function as the stopper, as in FIG. 1D. Additionally, this drawing shows a locking device 22 that prevents the mesh from extraction and retraction. The locking device can be any suitable type of lock, such as those commonly employed with other retractable products, such as tape measures, electric cords, animal leashes, sports nets, and the like.

Figure 5B:
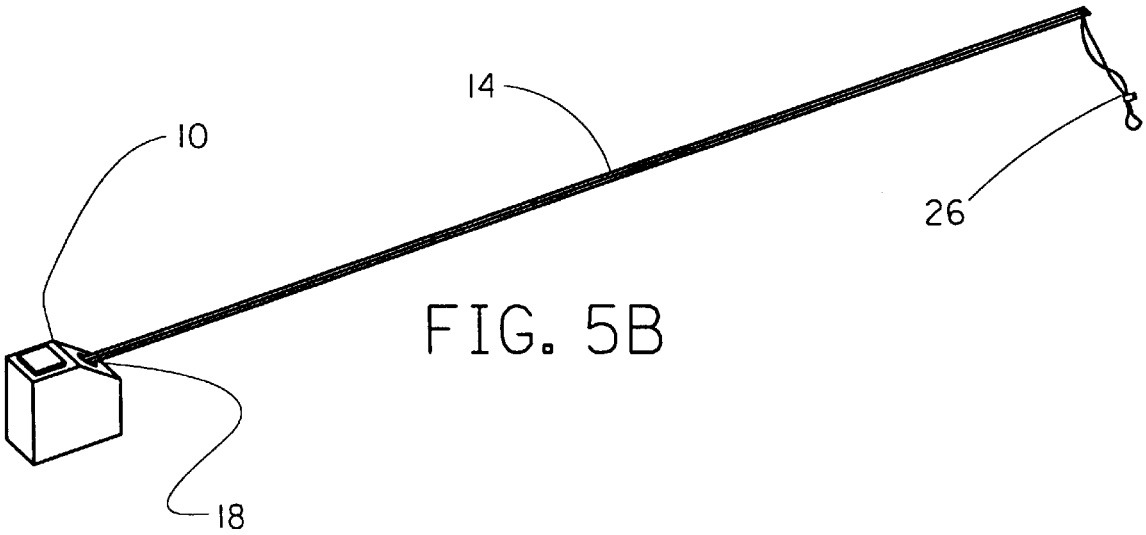
FIG. 5B is a second view of the preferred embodiment illustrated in FIG. 5A with the net in the collapsed position.

FIG. 5B shows the three-dimensional mesh member in a collapsed elongated form similar to that of a cable, rope, or strap, extending outwardly through opening 18 in retraction mechanism 10.

Figure 5C:
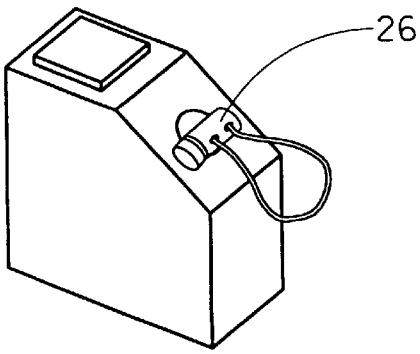
FIG. 5C is a third view of the preferred embodiment illustrated in FIG. 5A with the net in the stored position.

FIG. 5C shows the three-dimensional mesh member in the stored position. Only the stopper is exposed.

Figure 6:
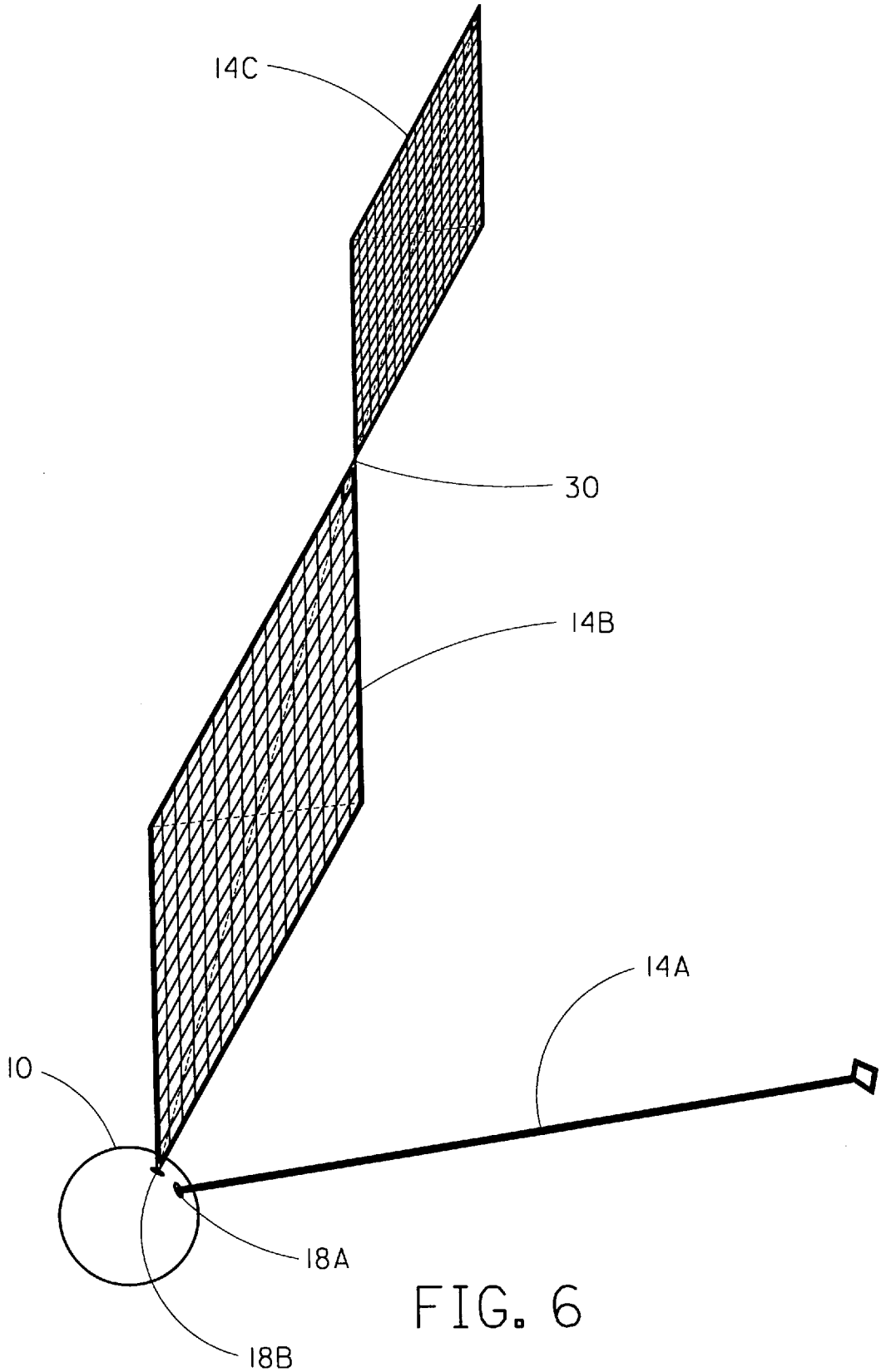
FIG. 6 is a perspective view of a fourth preferred embodiment of this mesh storage apparatus which stores multiple mesh members.

FIG. 6 shows another alternative embodiment of our mesh storage apparatus. This embodiment has a retraction mechanism that can store multiple mesh members. Multiple mesh members 14A, 14B, and 14C extend from their respective openings 18A and 18B. Mesh member 14A is shown in a collapsed elongated form. Both mesh members 14B and 14C are in partially deployed forms, extend through opening 18B, and are attached to each other by a connector 30. The connector can be any suitable attachment device, including, but not limited to, strings, hooks, clips, clamps, snaps, hook and loop fasteners such as Velcro or Latchlok, and the like.

Figure 7:
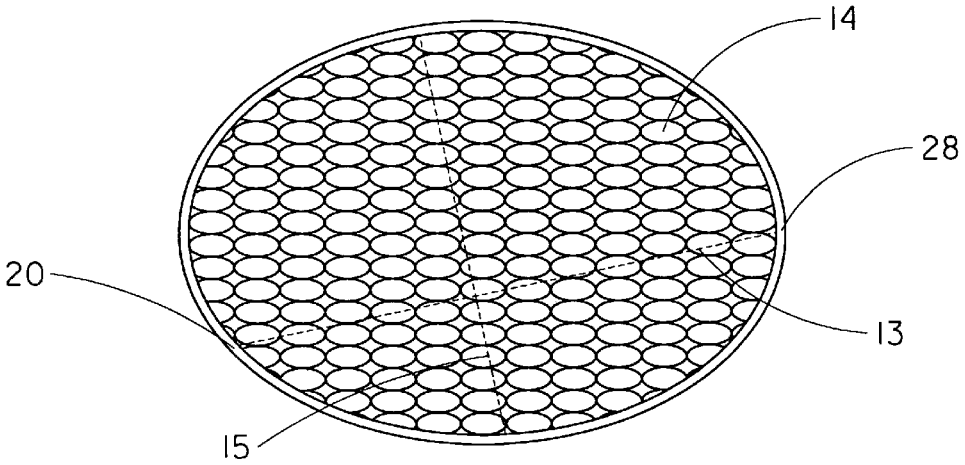
FIG. 7 is a top view of an oval net.

FIG. 7 shows an oval mesh member 14 with its major diagonal 13 and its minor diagonal 15 illustrated clearly. This drawing illustrates that the distal end does not have to be at a comer of the mesh and that the major diagonal, the line between distal end 28 and point of attachment 20, does not necessarily have to be the longest diagonal or a diagonal proper. It also illustrates another example of the many shapes the mesh opening structures can have.

Figure 8:
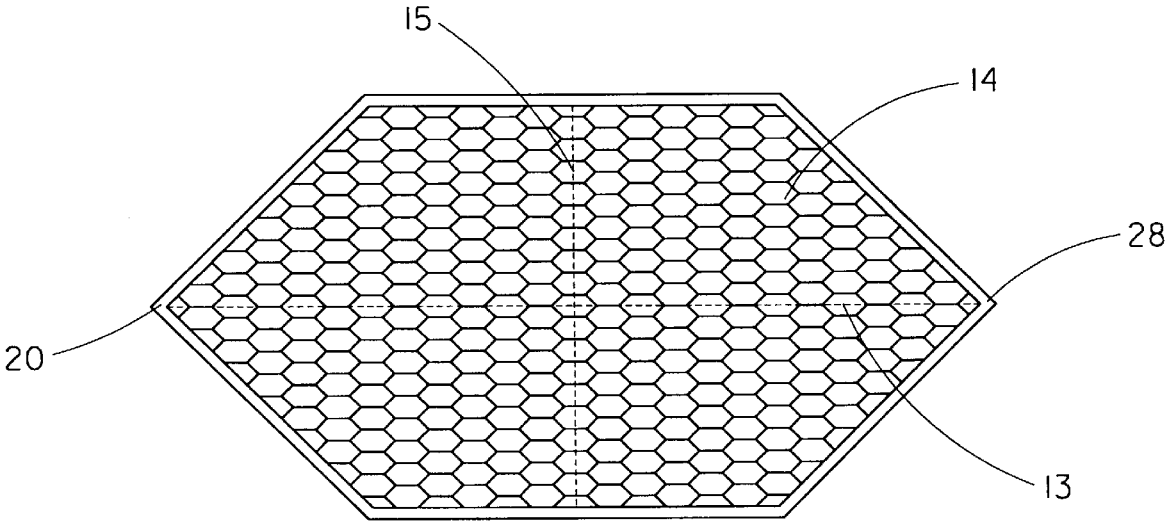
FIG. 8 is a top view of a hexagonal net.

FIG. 8 illustrates a hexagonal mesh member with hexagonal mesh openings.

Operation of Invention

To extract mesh member 14 in the embodiment shown in FIG. 1A, one grasps distal end 28 of the mesh and pulls it away from retraction mechanism 10. When one extracts the mesh from the retraction mechanism, the tension in the mesh structure keeps the mesh in a collapsed elongated form similar to that of a cable, rope, or strap. Once the net is extracted as far as necessary, one attaches it to an appropriate location on forklift 11. To deploy the mesh, one pulls the mesh along its minor diagonal as far as necessary and attaches it at suitable locations to hold in place items on pallet 12. To retract the mesh, all points of attachment are detached, leaving the distal end for last. Force is applied to points on the mesh structure such that an appropriate force is transferred throughout the mesh structure, causing the mesh structure to elongate in one direction (i.e. along the major diagonal) while contracting in a perpendicular direction (i.e. the minor diagonal). Once enough force has been applied, the immediate structure surrounding each opening is collapsed into two substantially parallel lines that are parallel to the major diagonal. The force can be applied by many sources, including, but not limited to, tension along the major diagonal and the shape of the retraction mechanism. In this embodiment, opening 18 (i.e. the shape of the retraction mechanism) applies force to the sides of the structure of the mesh, further causing the mesh to collapse as described above. Due to the shape of the retraction mechanism and the behavioral characteristics of conformal material, the mesh collapses into a rope-like form, enabling it to be wound into the retraction mechanism. The primary characteristic that our mesh storage apparatus exploits is the nature or tendency of the conformal material to contract along the major diagonal. By applying tension along major diagonal 13 between point of attachment 20 and distal end 28, one aids in the collapse of the mesh.

This particular application enhances safety of personnel, because our mesh storage apparatus is simple to operate. Traditional cargo nets and restraint devices for pallets and forklifts are complex and cumbersome; therefore, many people may choose not to use them or use them ineffectively. For instance, a pallet may be tied down with poorly knotted ropes.

In FIG. 2A, retraction mechanism 10 is mounted in truck bed 38. One pulls the exposed part of mesh member 14, which is used as a restraining net in this drawing, away from retraction mechanism 10. When one extracts the net from the retraction mechanism, the tension on the net and the contractility of its openings keep the net in a collapsed, rope-like form. Next, one attaches the distal end to an appropriate location on truck bed 38. Then, one deploys the net as discussed earlier.

To retract the net to the stored position, first one detaches all attached points, except for the distal end. The tension along the major diagonal and the contractility of the mesh openings cause the net to collapse into a cable-like, rope-like, or strap-like form. Then, one holds the distal end of the net while detaching it from truck bed 38. After the net is detached, while one holds the distal end, the net, maintaining its rope-like form, can then be retracted into the retraction mechanism as fast as one feels is appropriate.

The particular embodiments in FIGS. 1A and 2A are shown in use with a forklift and a truck, respectively; but they can be used in any vehicle, including, but not limited to, cars, trailers, airplanes, boats, bicycles, motorcycles, balloons, forklifts, tanks, and other vehicles used on the land, on or in water, or in the air or space.

Additionally, the mesh in FIGS. 1A and 2A is retracted automatically by a spring mechanism, similar to other retractable devices, such as tape measures, power cords, animal leashes, and the like. However, our mesh storage apparatus can employ any method of retraction including, but not limited to, rollers, rods, shafts, cranks, handles, spools, drums, balls, knobs, and arbors operated manually, automatically (e.g. spring tension), hydraulically, by motor (powered by electricity, battery, steam, combustion, sunlight, wind, or gravity), by magnet, or by any combination of manual, mechanical, hydraulic, motorized, and magnetic devices.

The embodiment shown in FIG. 3A stores an emergency escape rope ladder, which is powered manually. To extract and deploy the ladder, one grasps the distal end of the ladder and throws the ladder out window 23. One then attaches support point 24 to building 25. To retract the net, one just turns handle 27. The opening in the retraction mechanism will apply the necessary tension to the structure of the ladder to collapse the ladder into a rope-like form while ladder is being retracted.

The embodiment shown in FIGS. 4A and 4B operates in the same manner as the ones in FIGS. 1A and 2A. The only difference is that the application is a dishwasher, instead of a forklift or truck.

FIGS. 1A, 2A, and 4A illustrate how our mesh storage apparatus is used to store restraining nets, but it can also be used to store any conformal mesh, including, but not limited to, bags, mesh laundry bags/hampers, hammocks, ladders, decorative mesh, screening and filtering mesh, mesh partitions, mesh members used for electronic purposes (e.g. improving or distorting reception), and other conformal mesh members that can take advantage of the behavioral characteristics of conformal material for easy and compact storage. The member can be any conformal mesh made of any artificial or natural material, including, but not limited to, organic materials, plastics, metals, and any combination thereof.

The embodiment shown in FIG. 5A stores a three-dimensional mesh member 14, which is a mesh bag. This particular embodiment does not need to be secured to an object, because it can be hand held while used for shopping or just gathering items. If the user prefers, the mesh storage apparatus can be secured to a belt, belt loop, other clothing article, or an object for ease of use. The mesh bag is extracted from retraction mechanism 10 in the same manner as the mesh in FIGS. 1A, 2A, and 4A. Once the mesh bag is fully extracted, one engages locking device 22 to prevent the mesh bag from retracting into the retraction mechanism, leaving the bag exposed for use. Then one releases the retraction mechanism, and gravity pulls the mesh into useable form (a bag). One may need to loosen the drawstring to open the bag. To hold the bag open, one uses the drawstring as a handle. To retract the mesh bag, one grasps the drawstring with one hand and the retraction mechanism with the other and pulls the mesh taut so that it assumes a rope-like form. Then one disengages the locking device, allowing the retraction mechanism to retract the mesh automatically.

The embodiment shown in FIG. 6 operates in the same manner as those in FIGS. 1A, 2A, 4A, and 5A. The only difference is that this embodiment can store multiple mesh members.

Conclusion, Ramifications, and Scope

Accordingly, the reader will see that the mesh storage apparatus described above can be used to store a mesh member in a collapsed elongated form, which is more compact than has been done previously. It is easier to operate than traditional devices, because our mesh storage apparatus takes advantage of the contractility of the mesh openings and the behavioral characteristics of conformal material to collapse the mesh into a rope-like form for compact and convenient storage. The primary characteristic our mesh storage apparatus exploits is the ability of the mesh openings to collapse into two substantially parallel lines when pulled at two points in opposite directions along the major diagonal. When the openings collapse, the mesh member also collapses. While in a rope-like form, the mesh can be retracted in the same manner as tape measures, electric cords, animal leashes, and other retractable devices. Therefore, our mesh storage apparatus has the following advantages over the prior art:

It can be used in multiple applications and settings. Some examples of the multiple applications and settings are devices that store nets used to restrain or cover objects in any vehicle, including, but not limited to, cars, trailers, airplanes, boats, bicycles, motorcycles, balloons, forklifts, and other vehicles used for transportation on the land, on or in water, or in the air or space. Our mesh storage apparatus does not have to be used only with restraining nets. As demonstrated earlier, our mesh storage apparatus can be used to store meshes, nets, and other conformal materials, including, but not limited to, bags, mesh laundry bags/hampers, rope ladders, hammocks, decorative mesh, screening and filtering mesh, mesh partitions, mesh used for electronic purposes (e.g. improving or distorting reception), and other mesh members that can take advantage of the contractility of their openings and the behavioral characteristics of conformal material to collapse into a rope-like form.

It consumes less space so that the saved space can be used for other objects or purposes.

It allows the mesh to expand in two dimensions (for flat nets) so that the operator can use only as much mesh as is necessary. Similarly, our mesh storage apparatus allows three-dimensional mesh members to expand in three dimensions (for cone-shaped nets, mesh bags, hampers, and the like).

It is designed specifically for multiple scaleability.

It is simple to use.

It enhances safety in some embodiments because of its simplicity.

It requires substantially less material than traditional mesh storage devices, thus it is less expensive to manufacture.

It can be mounted temporarily so that it is portable and can be used in multiple settings. Additionally, it can be mounted permanently.

It can retract a mesh member with any method of retraction including, but not limited to, rollers, rods, shafts, cranks, handles, spools, drums, balls, knobs, and arbors operated manually, automatically (e.g. spring tension), hydraulically, by motor (powered by electricity, battery, steam, combustion, sunlight, wind, or gravity), by magnet, or by any combination of automatic, manual, mechanical, hydraulic, motorized, and magnetic means.

It can store any type of conformal mesh made of any artificial or natural material, including, but not limited to, organic materials, plastics, metals, and any combination thereof.

It can have the mesh permanently affixed to it, or the mesh can be detachable. This detachment characteristic allows one mesh storage apparatus to store different mesh members for different applications depending on the need at the time. Additionally, it allows worn out mesh members to be replaced easily.

It can store one mesh member or multiple mesh members simultaneously.

It reduces the chance of a mesh member's tangling or catching on other objects. This feature also allows easier warehousing and shipping.

Although the description above contains many specificities, these should not be construed as limiting the scope of the invention but as merely providing illustrations of some of the presently preferred embodiments of this invention. For example, our mesh storage apparatus can have various shapes and colors and can be constructed of various materials.

Thus the scope of the invention should be determined by the appended claims and their legal equivalents, rather than by the examples given.

The foregoing description of the preferred embodiments of the invention should be considered as illustrations of the invention and not as limiting. Additionally, the features described can be employed in any combination. For example, the embodiment illustrated in FIG. 6 could employ manual retraction (e.g. handles), could float, etc. Various changes and modifications will occur to those skilled in the art, such as variations in dimensions, materials, and colors. Different techniques can be used to secure the mesh to an object and to secure the retraction mechanism to a object. Such variations will occur to those skilled in the art without departing from the true scope of the invention as defined in the following claims.

We claim:

1. A method for storing one or more conformal mesh members, comprising the steps of:

(a) providing a storage device to which the one or more conformal members are attached, (b) applying force to points on the structure of said conformal mesh members such that an appropriate force is transferred throughout the mesh structure causing the immediate structure surrounding each opening to elongate in one direction while contracting in a perpendicular direction and thereby collapsing into two substantially parallel lines along the elongated direction, further collapsing the entire mesh members into elongated forms similar to those of cables, ropes, or straps, (c) retracting said one or more conformal mesh members in their elongated form or forms into or through an object for storage on or in said storage device, and (d) extracting said one or more conformal mesh members from or through said object for use, whereby the behavioral characteristics of conformal material are exploited to provide compact and convenient storage of the mesh members.

2. The method as described in claim 1 wherein said method further comprises the step of preventing the extraction, the retraction, or the extraction and retraction of the mesh members.

3. A method for storing one or more conformal mesh members, comprising the steps of:

(a) providing a winding device to which the one or more conformal mesh members are attached, (b) selecting appropriate opposing points on the conformal mesh members at which to apply tension, (c) applying tension between selected points causing the mesh members to elongate in a first direction and to contract in a second direction perpendicular to said first direction, further causing each mesh opening and its individual surrounding structure to collapse into two substantially parallel lines along the first direction, (d) winding the one or more elongated mesh members in their elongated form or forms into or through an object for storage on said winding device, and (e) extracting the one or more elongated mesh members from or through said object for use, whereby the behavioral characteristics of conformal material are exploited to provide compact and convenient storage of the mesh members.

4. The method as described in claim 3 wherein said method further comprises the step of preventing the extraction, the retraction, or the extraction and retraction of the mesh members.

5. A conformal mesh member storage apparatus comprising:

(a) a conformal mesh member having structure such that a force applied to the mesh member causes the immediate structure surrounding each opening to elongate in a first direction while contracting in a second direction perpendicular to the first direction, thereby collapsing into two substantially parallel lines along the elongated direction, further collapsing the entire mesh member into an elongated form similar to that of a cable, rope, or strap, (b) an object into or through which said conformal mesh member must pass for storage, (c) a means for attaching one end of the elongated conformal mesh member to a mechanism for retraction into or through said object for storage and for extraction from or through said object for use, and (d) a means for retracting said conformal mesh member into or through said object, whereby the behavioral characteristics of conformal material are exploited to provide compact and convenient storage of the mesh member.

6. The apparatus as described in claim 5, further including a device that, when engaged, will prevent the extraction, the retraction, or the extraction and retraction of the conformal mesh member.

7. The apparatus as described in claim 5, further including a device that prevents the mesh member from retracting completely into or through said object.

8. The apparatus as described in claim 5 wherein said mesh storage apparatus is floatable.

9. The apparatus as described in claim 5, further including a means for attaching said conformal mesh member storage apparatus to a support.

* * * * *